US007674087B2

(12) United States Patent
He et al.

(10) Patent No.: US 7,674,087 B2
(45) Date of Patent: Mar. 9, 2010

(54) METHOD FOR LOADING OF CONTAINER USED TO SHIP SEMI-TRAILER CHASSIS

(75) Inventors: Sidong He, Guangdong (CN); Shulin Yang, Guangdong (CN); Feng Wang, Shenzhen (CN); Xuezhong Ye, Shenzhen (CN)

(73) Assignee: China International Marine Containers (Group) Co., Ltd., Guangdong (CN)

( * ) Notice: Subject to any disclaimer, the term of this patent is extended or adjusted under 35 U.S.C. 154(b) by 124 days.

(21) Appl. No.: 11/095,606

(22) Filed: Apr. 1, 2005

(65) Prior Publication Data

US 2005/0232750 A1 Oct. 20, 2005

(30) Foreign Application Priority Data

Apr. 6, 2004 (CN) ..... 2004 2 0049821 U
Feb. 5, 2005 (CN) ..... 2005 1 0052317

(51) Int. Cl.
*B65G 61/00* (2006.01)
*B65D 21/00* (2006.01)
*B62D 39/00* (2006.01)

(52) U.S. Cl. ..... 414/802; 410/31; 410/82; 206/512; 280/33.998

(58) Field of Classification Search ..... 410/57, 410/31, 35, 43, 46, 5, 56, 7, 82; 280/33.998, 280/33.991, 33.997; 414/788, 788.1, 788.2, 414/795.6, 222.01, 331.01, 801, 802; 108/55.1, 108/56.1; 206/386, 509, 511–512, 600; 211/191, 211/195; 220/1.5
See application file for complete search history.

(56) References Cited

U.S. PATENT DOCUMENTS

| | | | | |
|---|---|---|---|---|
| 4,611,962 | A * | 9/1986 | Braly et al. | 410/57 |
| 4,650,381 | A * | 3/1987 | Durkin | 410/43 |
| 4,986,705 | A * | 1/1991 | Durkin | 410/57 |
| 6,422,795 | B2 * | 7/2002 | Holt et al. | 410/115 |
| 6,969,104 | B2 * | 11/2005 | Green | 296/26.09 |
| 6,979,005 | B1 * | 12/2005 | McLerran | 280/33.998 |
| 2005/0220559 | A1 * | 10/2005 | Yang et al. | 410/56 |

* cited by examiner

*Primary Examiner*—Gregory W Adams
(74) *Attorney, Agent, or Firm*—Finnegan, Henderson, Farabow, Garrett & Dunner, LLP

(57) ABSTRACT

A method used for loading semi-trailer chassis into a container, wherein the container includes a base frame and four frame structures attached to corner posts of the base frame. Four semi-trailer chassis are stacked into the container from bottom to top, where the first semi-trailer chassis is placed upside down, the second semi-trailer chassis is placed right-side up and turned horizontally at a 180 degree angle, the third semi-trailer chassis is placed upside down, and the fourth semi-trailer chassis is placed right-side up and turned horizontally at a 180 degree angle.

14 Claims, 5 Drawing Sheets

METHOD FOR LOADING OF CONTAINER USED TO SHIP SEMI-TRAILER CHASSIS

FIELD OF THE INVENTION

The invention relates to an apparatus and method for shipping semi-trailer chassis, and more particularly to a frame container used to ship semi-trailer chassis and method for loading the semi-trailer chassis into a frame container.

BACKGROUND OF THE INVENTION

Semi-trailer chassis are widely used as tools for transporting containers. During use, a semi-trailer chassis can be hauled by a trailer vehicle, and a container can be fixed onto the semi-trailer chassis.

At the present time, the manufacture of semi-trailer chassis has been transferred to developing countries to reduce production costs; however, the main consumer markets still remain in the industrialized countries. Because various modes of transportation, e.g., via highway, railway, or by sea, are required to ship semi-trailer chassis from the location of manufacture to the marketplace, the cost of shipping is a key factor that affects the final cost of the product. Usually, high shipping costs will significantly increase the final cost of the product and therefore cause a loss in market competitiveness.

Conventionally, semi-trailer chassis are shipped by sea using bulk cargo ships, where five units of semi-trailer chassis are secured and stacked on top of one another for shipping. By using this method, the shipping process can be complicated and the shipping costs are high. Also, because there is a shortage of bulk cargo shipping lines, it is difficult to schedule and satisfy the demand for shipping semi-trailer chassis using only bulk cargo shipping lines instead of container lines. As a result, this directly affects the production costs of semi-trailer chassis. Therefore, it is necessary to adopt an efficient and low-cost shipping method.

Containers are standard international, general-purpose shipping tools used in various modes of transportation. Containers can be stacked to maximize the storage capacity, e.g., on the deck of a ship, so that the shipping costs can be reduced and shipping efficiency can be enhanced.

By using containers to ship semi-trailer chassis, provided that the size of the container after loading meets the length, width, and height requirements for standard container shipping, it is possible to use various modes of transportation, containerize the transportation of semi-trailer chassis, and reduce shipping costs. However, due to the special structure of semi-trailer chassis, the design of the container and the loading method will directly determine whether it is possible to ship the semi-trailer chassis. The design of the container and the loading method will also determine the overall size of the container after the semi-trailer chassis have been loaded, and the maximum quantity of semi-trailer chassis that can be shipped by a container.

SUMMARY OF THE INVENTION

The purpose of this invention is to provide a method for loading semi-trailer chassis into a container for shipping. The size of the container after loading the semi-trailer chassis should meet the requirements for containers used in various modes of transportation, so that the semi-trailer chassis can be containerized for shipping, and the quantity of semi-trailer chassis to be loaded into a container can be maximized to reduce shipping costs.

To realize the above-mentioned purpose, the technical solution of the invention is described as follows.

In a method used for loading semi-trailer chassis into a shipping container according to one example of the present disclosure, where the container includes a base frame and four frame structures attached to corner posts secured to the base frame, four semi-trailer chassis are loaded into the container in order from bottom to top, where the first semi-trailer chassis is placed upside down, the second chassis is placed right-side up and turned horizontally at a 180 degree angle, the third chassis is placed upside down, and the fourth chassis is placed right-side up and turned horizontally at a 180 degree angle.

In a preferred embodiment of this invention, in the above-described method used for loading semi-trailer chassis into a container for shipping, a rear end of the first semi-trailer chassis where wheels are installed (the wheel end) is placed close to corner posts at one end of the container and is supported by a carrying face of bottom side beams of the container. A lock located at the wheel end of the semi-trailer is locked into a lock hole located on the bottom side beam of the container.

According to one exemplary embodiment of the present disclosure, the second semi-trailer chassis is placed on top of the first semi-trailer chassis, and the wheels of the second semi-trailer chassis are in contact with a gooseneck beam of the first semi-trailer chassis, and the wheels of the first semi-trailer chassis are in contact with a gooseneck beam of the second semi-trailer chassis. A rear end of the second semi-trailer chassis is positioned adjacent to two corner posts of the container. The method used for loading the first and second semi-trailer chassis is repeated for loading the third and fourth semi-trailer chassis.

According to one exemplary embodiment of the present disclosure, in which the semi-trailer chassis are positioned in order from bottom to top, an axle of a wheel suspension frame and reinforcing plates of legs of the first semi-trailer chassis are in contact with reinforcing plates of legs and an axle of a wheel suspension frame of the second semi-trailer chassis, respectively. The same arrangement can be used for loading the third and fourth semi-trailer chassis.

According to one exemplary embodiment of the present disclosure, the second semi-trailer chassis and the first semi-trailer chassis are positioned in reverse order from tail to head. The rear end of the second semi-trailer chassis is positioned adjacent to the two corner posts at the other end of the container, its wheels are supported by a carrying face of the bottom side beams of the container, and the legs of the second semi-trailer chassis are adjusted so that they are supported by the base frame of the container. The same arrangement can be used for loading the third and fourth semi-trailer chassis.

After the four semi-trailer chassis are loaded into the container, the four semi-trailer chassis may be secured to the container (e.g., tied to the container).

By adopting the above-mentioned technical solution, the loading space of the container can be effectively used to load four semi-trailer chassis with a length of 40 feet, 20 feet, or a telescopic chassis with a length of 45 feet, 53 feet, or any other size. The loading capacity is enhanced, shipping costs have been significantly reduced compared with bulk cargo shipping, and the requirements for containerization used in various modes of through-shipping are satisfied. The scheduled use of various modes of through-shipping can be realized by using container lines, thus satisfying the shipping demands for semi-trailer chassis.

BRIEF DESCRIPTION OF THE DRAWINGS

A better understanding of the technical features and other benefits of this invention will become apparent from the following detailed description of the preferred embodiments of this invention in combination with the attached drawings.

DESCRIPTION OF THE PREFERRED EMBODIMENTS

To further understand the technical aspects of this invention, please refer to the following detailed description and the attached drawings. The attached drawings are provided for reference and illustration purposes only, and are not intended to limit the scope of this invention.

To make full use of the space within a frame-type container for effectively loading semi-trailer chassis with a length of 40 feet, 20 feet, or a telescopic length of 45 feet, 53 feet, or any other specification, a new type of container and method for loading semi-trailer chassis is described in this disclosure.

Figure 1:
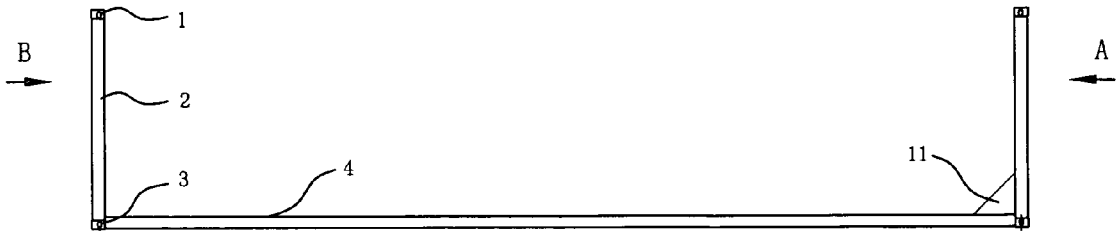
FIG. 1 is a side view of a container described in this invention used for shipping semi-trailer chassis according to one embodiment of the disclosure.
Figure 2:
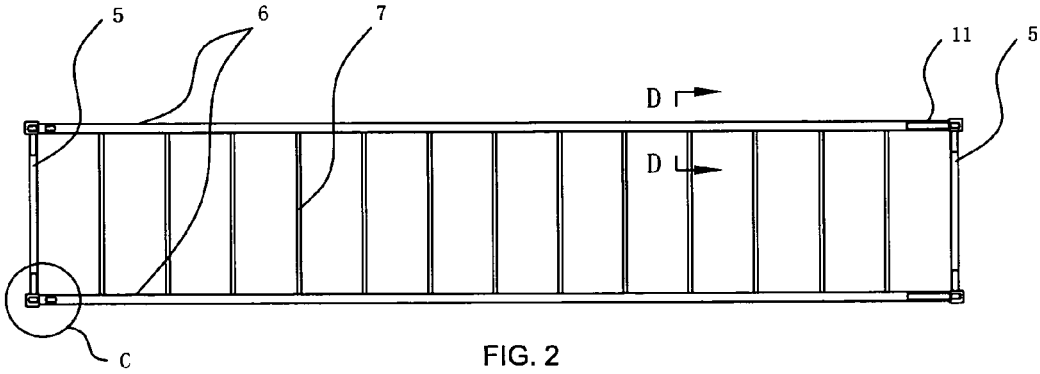
FIG. 2 is top view of the container of FIG. 1.

As shown in FIGS. 1 and 2, a container used for transporting semi-trailer chassis has an open-frame structure, including a base frame 4 and four corner posts 2. Top corner parts 1 are fixed on the top of corner posts 2. The bottom of base corner parts 3 are fixed onto base frame 4. Base frame 4 includes two bottom side beams 6, between which are fixed numerous bottom cross beams 7 placed in parallel, doorsills 5, and base corner parts 3.

Numerous alternative methods may be used for fixing bottom side beams 6, doorsills 5, and corner posts 2. For example, the first alternative method is to have the ends of two bottom side beams 6 fixed to two base corner parts 3 located at the ends of two corner posts 2 at one end of base frame 4, and having a doorsill 5 installed between two base corner parts 3; the second alternative method is to have the ends of two bottom side beams 6 fixed to two base corner parts 3 located at the ends of two corner posts 2 at one end of base frame 4, and have doorsill 5 installed directly between two bottom side beams 6, so that the space between the two bottom side beams 6 can be reduced, therefore reducing the length of bottom cross beams 7 and saving materials; the third alternative method is to have bottom side beams 6 and doorsills 5 directly fixed onto corner posts 2. There are other options for assembling the container. A first embodiment of an assembled container is shown in FIGS. 1 and 2.

One embodiment of a method for loading semi-trailer chassis is illustrated in FIGS. 13-16. As shown in the figures, four units of semi-trailer chassis are loaded into the container.

In order to satisfy the requirements for transportation in various modes, the external width, height, and positions of the corner parts of an ISO 1 AAA-type container is adopted, whereas the external length meets or exceeds the standards of an ISO 1 AAA-type container.

In order to load four semi-trailer chassis into the container, upon loading, every two semi-trailer chassis must be arranged in reverse order from head to tail and placed opposing each other, so that the wheels of the first semi-trailer chassis and a gooseneck beam of the second semi-trailer chassis can be in contact to form a unit. Then the two units, each containing two semi-trailer chassis, are stacked and loaded inside the container. This specific loading method is described as follows.

Figure 8:
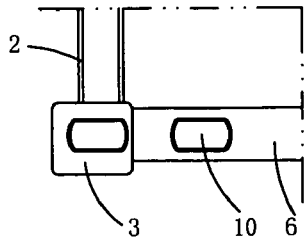
FIG. 8 is an enlarged view of the portion C shown in FIG. 2.
Figure 13:
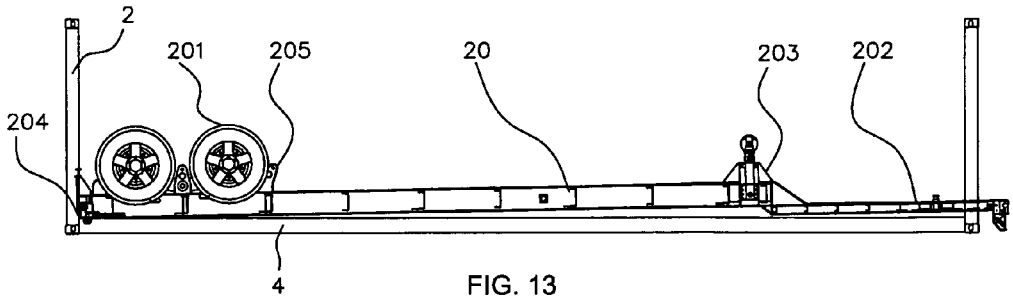
FIG. 13 is an abridged general view illustrating a first semi-trailer chassis that has been loaded into a container according to one embodiment of the disclosure.

First, as illustrated in FIG. 13, a first semi-trailer chassis 20 is placed upside down (i.e., in an inverted manner) on bottom frame 4 of the container. The rear end of the first semi-trailer chassis 20 is close to the two corner posts 2 at a first end of the container and is supported by the carrying face of the bottom side beams 6 of the container. The semi-trailer chassis typically has a lock 204 at the rear end of the semi-trailer chassis that can be locked into a lock hole 10 located on the bottom side beam 6, as shown in FIGS. 2 and 8.

Figure 14:
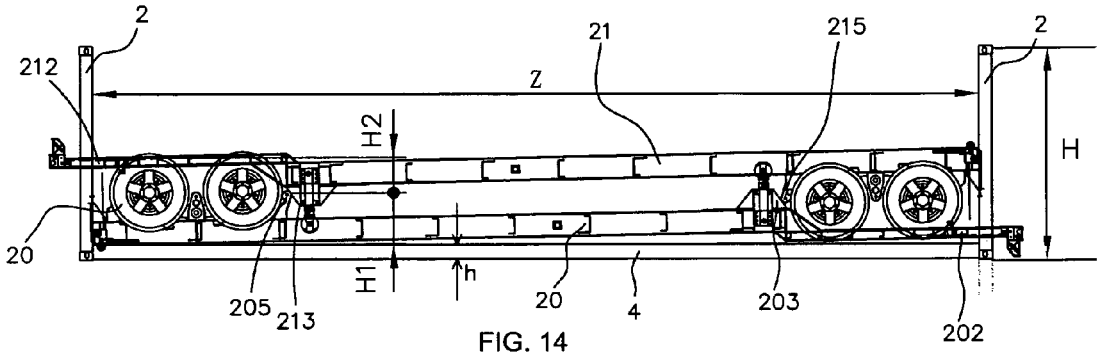
FIG. 14 is an abridged general view illustrating a second semi-trailer chassis that has been loaded into a container according to one embodiment of the disclosure.

Secondly, as illustrated in FIG. 14, a second semi-trailer chassis 21 is placed on top of the first semi-trailer chassis 20 in a non-inverted manner, so that the second semi-trailer chassis 21 is in contact with the first semi-trailer chassis 20 at wheels 201 and gooseneck beam 202. The first and second semi-trailer chassis 20, 21 are placed in reverse order from head to tail. The rear end of the second semi-trailer chassis 21 is adjacent to two corner posts 2 at a second end of the container.

Figure 15:
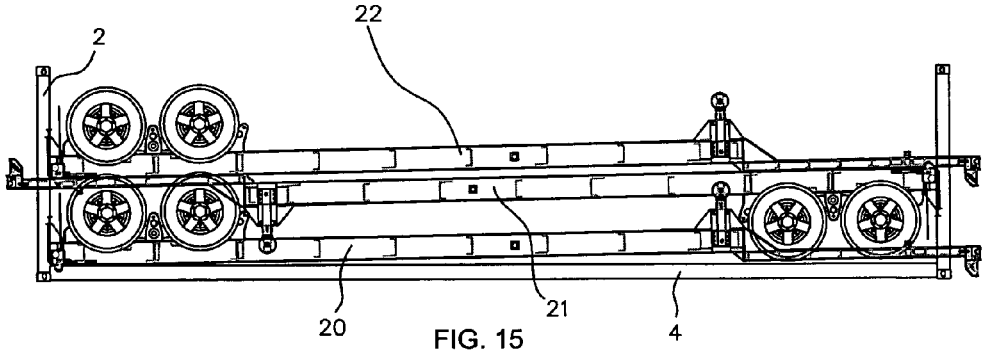
FIG. 15 is an abridged general view illustrating a third semi-trailer chassis that has been loaded into a container according to one embodiment of the disclosure.

Thirdly, as illustrated in FIG. 15, a third semi-trailer chassis 22 is placed upside down on top of the second semi-trailer chassis 21, so that its head-to-tail direction is identical with the first semi-trailer chassis 20, and its rear end is adjacent to the two corner posts 2 at the first end of the container.

Figure 16:
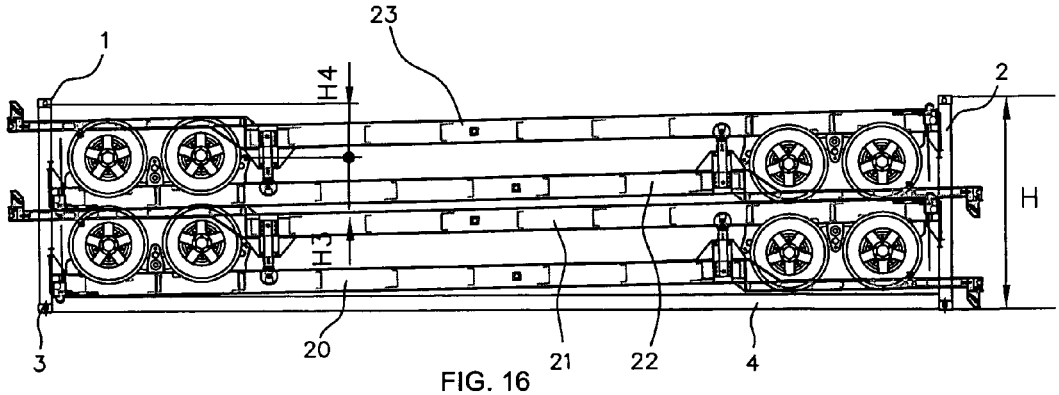
FIG. 16 is an abridged general view illustrating a fourth semi-trailer chassis that has been loaded into a container according to one embodiment of the disclosure.

Fourthly, as illustrated in FIG. 16, the fourth semi-trailer chassis 23 is placed on top of the third semi-trailer chassis 22, so that the wheels of the fourth semi-trailer chassis 23 are in contact with a gooseneck beam of the third semi-trailer chassis 22, and the wheels of the third semi-trailer chassis 22 are in contact with a gooseneck beam of the fourth semi-trailer chassis 23. The head-to-tail direction of the fourth semi-trailer chassis 23 is identical to the second semi-trailer chassis 21, where its rear end is adjacent to the two corner posts 2 at the second end of the container.

Finally, the four semi-trailer chassis are secured to the container body (e.g., tied to the container body).

Figure 17:
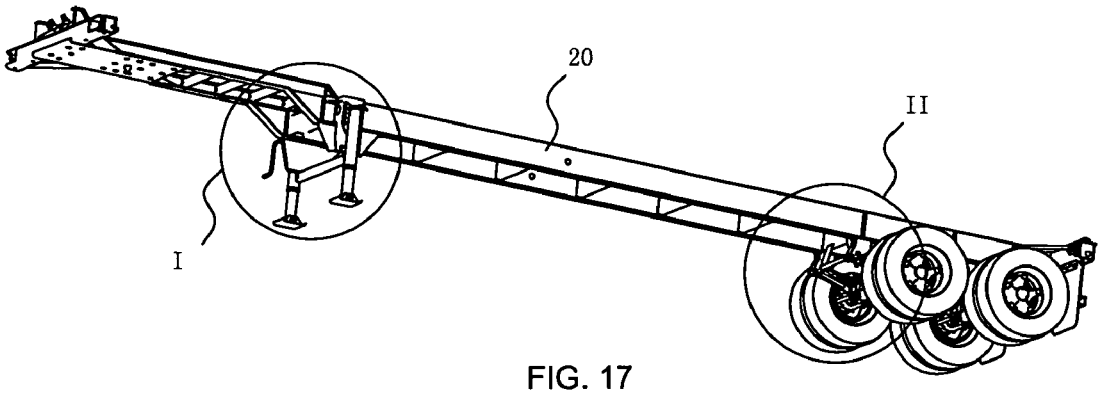
FIG. 17 is a schematic view of a semi-trailer chassis.
Figure 18:
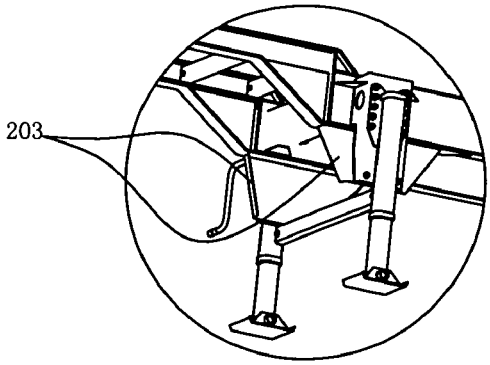
FIG. 18 is an enlarged view of section I shown in FIG. 17.
Figure 19:
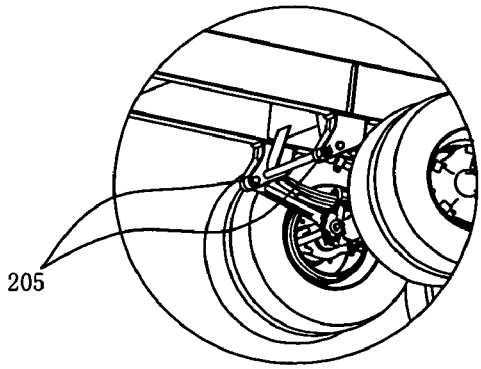
FIG. 19 is an enlarged view of section II shown in FIG. 17.

During loading, an axle of wheel suspension frame 205 and reinforcing plates 203 of legs of the first semi-trailer chassis 20 are in contact with reinforcing plates 213 of legs and an axle of wheel suspension frame 215 of the second semi-trailer chassis 21, respectively. FIGS. 17-19 show the structure of a wheel suspension frame 205 and a reinforcing plate 203 of a leg. This arrangement can be repeated when loading the third and fourth semi-trailer chassis.

The dimension parameters used in FIGS. 13-16 are illustrated below:

Z: an internal width of the container, i.e., the distance between the internal side face of the left and right corner posts 2.

H1: a vertical distance between the carrying face of the first semi-trailer chassis 20 and the tangent point of the axle of the wheel suspension frame 205 of the first semi-trailer chassis 20 and the reinforcing plates 213 of the legs of the second semi-trailer chassis 21. The axle of the wheel suspension frame has a circular shape, and the reinforcing plates of the legs are beveled; therefore, the position of the point of tangent of the two is fixed each time the semi-trailer chassis are positioned in the same manner, i.e., H1 is a constant determined by the structure parameter of the semi-trailer chassis.

H2: a vertical distance between the point of tangent mentioned in H1 and the orthogonal projection of gooseneck beam 212 of the second semi-trailer chassis 21 on left corner posts 2 of the container, where the position of the above-mentioned point of tangent on the reinforcing plates of the legs will change according to the relative horizontal stacking position of the two units of semi-trailer chassis, i.e., it will change when the width Z changes.

H3: a vertical distance between the carrying face of the third semi-trailer chassis 22 and the point of tangent of the axle of the wheel suspension frame of the third semi-trailer chassis 22 and the reinforcing plates of the legs of the fourth semi-trailer chassis 23; it is identical or related to H1.

H4: a vertical distance between the point of tangent mentioned in H3 and the top of the handle plate of the fourth semi-trailer chassis 23; it is related to H2.

h: height of the bottom side beam.

H: external height of the container.

To meet the standard required for shipping the container, the stacking of the four semi-trailer chassis should not exceed the top surface of top corner part 1, i.e., H is the total (or greater than the total) of h, H1, H2, H3, and H4.

The width Z determines the relative position of the stacking of each group of semi-trailer chassis (the first and the second, the third and the fourth), i.e., H2 is determined by the height of the tangent of the axle of the wheel suspension frame 205 of the first semi-trailer chassis 20 and the reinforcing plates 213 of the legs of the second semi-trailer chassis 21. That is to say, H2 is dependent on the variable Z. H4 is also dependent on the variable Z.

$$H2=F_1(Z)$$

$$H4=F_2(Z)$$

h is specified by a national standard, where h equals H minus H1, H2, H3, and H4; therefore, h is also dependent on the variable Z.

$$h=F_3(Z)$$

To load a semi-trailer chassis with a length of 40 feet, or a telescopic length of 45 feet or 53 feet, there are at least two requirements regarding the structural parameters of the container: first, the rear end cross beam of the first semi-trailer chassis 20, which is supposed to be loaded upside down as the bottom unit, should be adjacent to the two corner posts 2 at one end of the container and should rest on bottom side beams 6. The rear end of the second semi-trailer chassis 21, which is loaded right-side up in a reverse direction, should be adjacent to the two corner posts 2 at the other end of the container, where its wheels are positioned on bottom side beam 6. By loading the four semi-trailer chassis in such a manner, it ensures that the loading height of the four semi-trailer chassis will not exceed the surface height of top corner part 1. In one embodiment, the distance between the lowest point of the carrying face of bottom side beam 6 and the bottom face of the base corner part 3 is less than or equal to 365 mm. Secondly, the horizontal distance between the internal surfaces of the two opposing corner posts 2 of the container should be no greater than or equal to 11836 mm. The requirements for loading are ideally met when the horizontal distance is 11846 mm.

Figure 3:
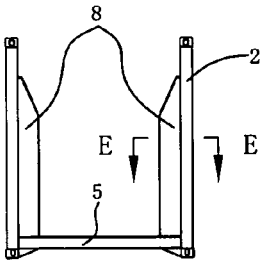
FIG. 3 is a front view of the container of FIG. 1 shown from direction A.

As illustrated in FIG. 3, to realize the design target for the horizontal distance between the two corner posts 2 mentioned above being greater than or equal to 11836 mm, and to ensure that the corner posts 2 meet the strength requirements of the ISO test, on the internal side of the two corner posts 2, which are at the same end of base frame 4, according to one embodiment, a corner post reinforcing structure 8 is used, which extends from an upper portion of corner post 2 to its bottom portion, and is fastened to corner post 2 and doorsill 5 to strengthen the cross rigidness of corner post 2. Meanwhile, according to one exemplary embodiment, a reinforcing structure 11 between corner post 2 and bottom side beam 6 may be used. As illustrated in FIG. 1, the reinforcing structure 11 can be adopted using a reinforcement bar plate, a reinforcement cross stay, and other common strengthening structures to enhance the lengthwise rigidness of corner post 2. To make it more convenient to load semi-trailer chassis, there is guiding slope on the top section of the corner post reinforcing structure 8.

Figure 4:
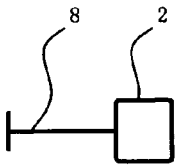
FIG. 4 is an enlarged sectional view of a corner post of the container of FIG. 3 taken along line E-E according to one embodiment of the disclosure.
Figure 5:
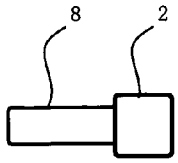
FIG. 5 is an enlarged sectional view of a corner post of the container of FIG. 3 taken along line E-E according to another embodiment of the disclosure.
Figure 6:
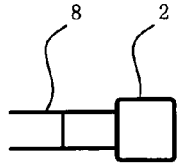
FIG. 6 is an enlarged sectional view of a corner post of the container of FIG. 3 taken along line E-E according to a further embodiment of the disclosure.

Different designs for the cross section for corner post reinforcing structure 8 may be employed, for example, as shown in FIGS. 4, 5, and 6: a T-shaped cross section, a channel cross section, and an I-shaped cross section.

Figure 7:
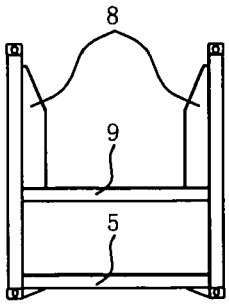
FIG. 7 is an end view of the container of FIG. 1 shown from direction B.

As illustrated in FIG. 7, a horizontal beam 9 is fastened at an appropriate position along the lower-middle part of two corner posts 2 at one end of the container. In one embodiment, the corner post reinforcing structure 8 extends from the upper part of corner post 2 down to horizontal cross beam 9, and is fastened to corner post 2 and horizontal cross beam 9. The height of horizontal cross beam 9 should be suitable so that, after loading the second semi-trailer chassis 21, the undersurface of the front end gooseneck beam 212 of the second semi-trailer chassis 21 can be supported by horizontal cross beam 9 to ensure the horizontal stability of the second semi-trailer chassis 21. In another embodiment, if after the two corner posts 2 are fastened together by horizontal cross beam 9, the corner post 2 has enough lengthwise rigidness to meet the strength requirements of the ISO test, the reinforcing structure 11, which is located between a corner post 2 and bottom side beam 6, may not be needed.

As illustrated in FIG. 8, to make it more convenient to load semi-trailer chassis at an appropriate position adjacent to the bottom corner parts on both sides of bottom side beam 6, lock holes 10 are defined at positions corresponding to the rear end locks of the semi-trailer chassis. When the first semi-trailer chassis 20 is loaded upside down on base frame 4, its rear end locks can lock up the first semi-trailer chassis 20 in lock holes 10. The position of lock hole 10 should enable the rear end of the first semi-trailer chassis 20 to be adjacent to the neighboring corner posts 2 after the first semi-trailer chassis 20 has been locked up.

Figure 9:
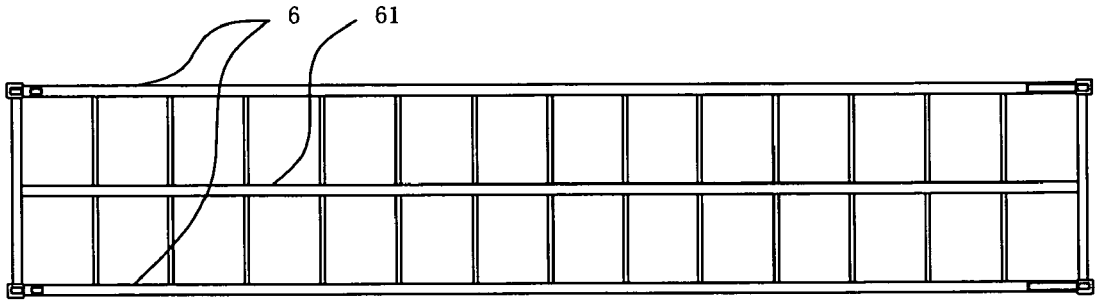
FIG. 9 is a top view of another embodiment of the container.

To ensure that the ISO strength requirements are met regarding the container body, while also ensuring that the carrying face of the bottom side beam 6 is at the required height, in one exemplary embodiment, a base frame structure with three or more pieces can be adopted. In FIG. 9, a base frame structure with two bottom side beams 6 and a middle bottom side beam 61 is illustrated. The middle bottom side beam 61 takes a part of the bending moment load of bottom side beams 6, so that bottom side beams 6 and middle bottom side beam 61 can meet the height requirements.

Figure 10:
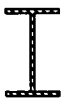
FIG. 10 is an enlarged sectional view of a bottom side beam taken along line D-D in FIG. 2 according to one embodiment of the disclosure.
Figure 11:
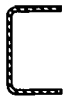
FIG. 11 is an enlarged sectional view of a bottom side beam taken along line D-D in FIG. 2 according to another embodiment of the disclosure.
Figure 12:
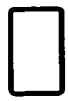
FIG. 12 is an enlarged sectional view of a bottom side beam taken along line D-D in FIG. 2 according to one embodiment of the disclosure.

To ensure that ISO strength requirements are met regarding the container body, while also ensuring that the carrying face of the bottom side beam 6 is at the required height, different designs of the cross section of the bottom side beam 6 can be used to meet these requirements. FIGS. 10, 11, and 12 show three types of cross sections that can be adopted for bottom side beam 6, respectively, an I-shaped cross section, a channel cross section, and a rectangular cross section. To maximize the resistance to bending of bottom side beam 6 and save material, it is workable to adopt one of the above-mentioned cross section shapes or a combination of these cross section shapes at different sections of the bottom side beam 6. Of course, it is workable to adopt a configuration of a reinforcing plate on the top side face on the middle section of the bottom side beam 6 or to use any other common structural solution to strengthen the bottom side beam 6.

The so-called "fastening" mentioned above may refer to connection methods that meet the requirements for structure strength described above, including weld connection, bolt connection, rivet connection, adherence, etc.

In the method used for loading semi-trailer chassis with telescopic lengths of 45 or 53 feet, the length of the semi-trailer chassis may be contracted to 40 feet, and then the same steps used for loading a 40-foot semi-trailer chassis can be used.

FIGS. 20-23 show a second embodiment of the loading method of this invention, illustrating a method used for loading a 20-foot semi-trailer chassis into a container.

Figure 20:
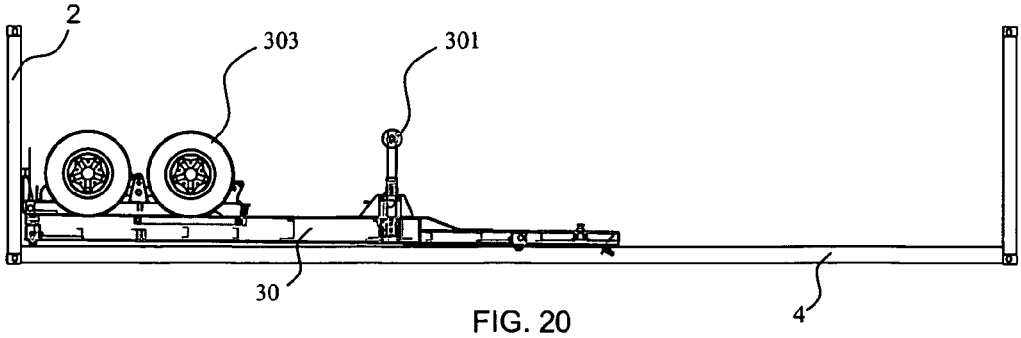
FIG. 20 is an abridged general view illustrating a first semi-trailer chassis that has been loaded into a container according to another embodiment of the disclosure.

First, as illustrated in FIG. 20, first semi-trailer chassis 30 is placed upside down on base frame 4 of the container. The rear end of the first semi-trailer chassis 30 is close to the two corner posts 2 at the first end of the container and supported by the carrying face of the bottom side beams of the container. The rear end of the first semi-trailer chassis 30 may be locked into the lock holes on the bottom side beams of the container.

Figure 21:
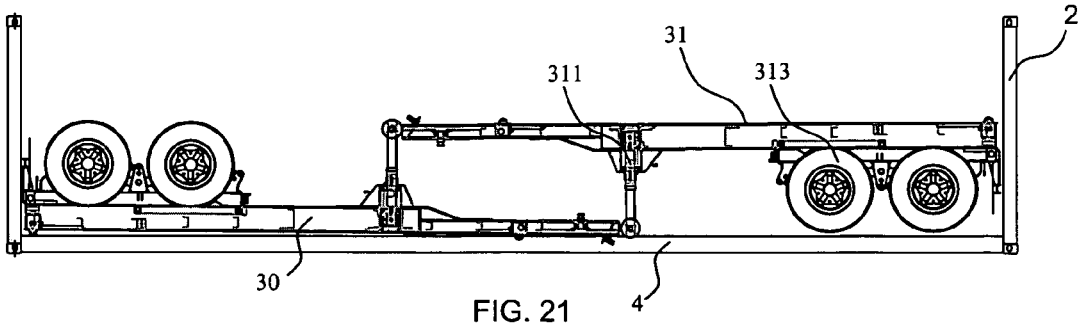
FIG. 21 is an abridged general view illustrating a second semi-trailer chassis that has been loaded into a container.

Secondly, as illustrated in FIG. 21, the second semi-trailer chassis 31 is placed on the other end of base frame 4 of the container in a reverse head-to-tail direction with the first semi-trailer chassis 30. The rear end of the second semi-trailer chassis 31 is adjacent to the two corner posts 2 at the other end (second end) of the container. Its wheels 313 are supported by the carrying face of the bottom side beams of the container, its front side is above the front end of the first semi-trailer chassis 30, and legs 311 of the second semi-trailer chassis 31 are supported by base frame 4.

Figure 22:
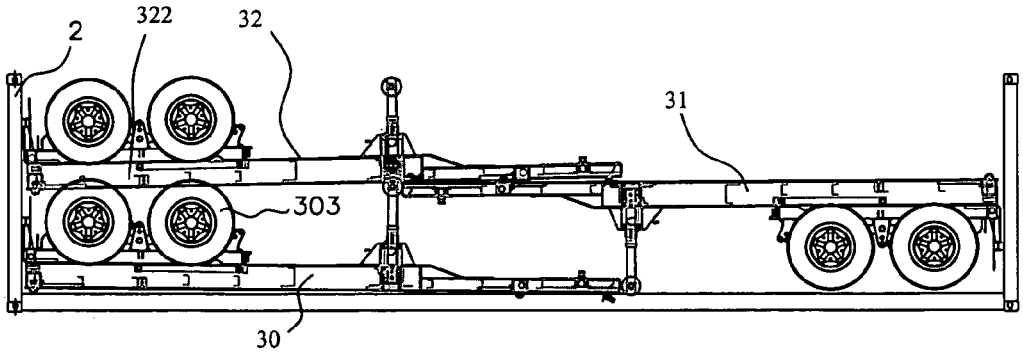
FIG. 22 is an abridged general view illustrating a third semi-trailer chassis that has been loaded into a container.

Thirdly, as illustrated in FIG. 22, the third semi-trailer chassis 32 is placed upside down on top of the first semi-trailer chassis 30, so that its head-to-tail direction is the same as the first semi-trailer chassis 30. The rear end of the third semi-trailer chassis 32 is adjacent to the two corner posts 2 at the first end of the container, and wheels 303 of the first semi-trailer chassis 30 and girder 322 of the third semi-trailer chassis 32 are in contact, and the front end support of the third semi-trailer chassis 32 rests on legs 301 of the first semi-trailer chassis 30.

Figure 23:
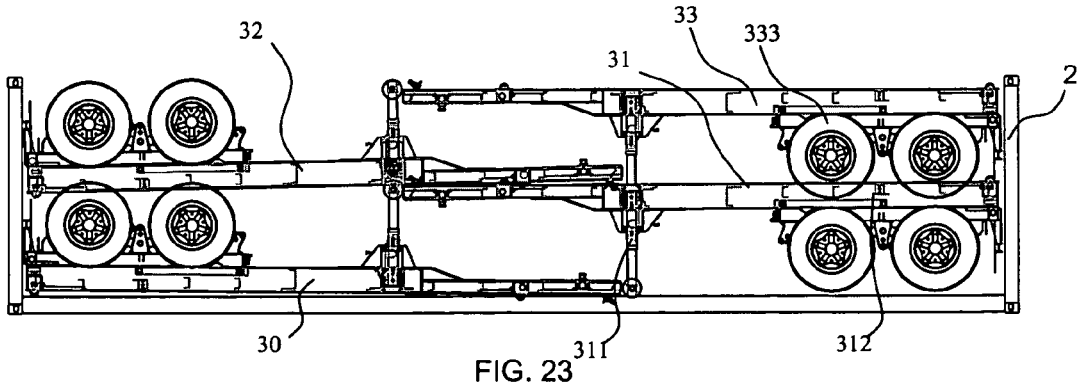
FIG. 23 is an abridged general view illustrating a fourth semi-trailer chassis that has been loaded into a container.

Fourthly, as illustrated in FIG. 23, the fourth semi-trailer chassis 33 is placed on top of the second semi-trailer chassis 31 in the same direction as the second semi-trailer chassis 31, so that wheels 333 of the fourth semi-trailer chassis 33 and girder 312 of the second semi-trailer chassis 31 are in contact. The rear end of the fourth semi-trailer chassis 33 is adjacent to the two corner posts 2 at the second end of the container, and its front end support is above the legs 311 of the second semi-trailer chassis 31.

Finally, the four semi-trailer chassis may be secured to the container (e.g., tied to the container).

Although illustrative embodiments of the present invention have been described herein with reference to the attached drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention, as defined by the appended claims.

What is claimed is:

1. A method for loading semi-trailer chassis in a container comprising:

providing a container having a base frame and corner posts, the base frame having corner parts at four corners of the container for interlocking containers and two side beams extending in a longitudinal direction between the corner parts, each side beam having an upper and a lower surface extending in the longitudinal direction from one corner part to another corner part and a locking hole defined between the upper and lower surfaces;

placing a first semi-trailer chassis in an inverted manner on the base frame of the container and locating wheels of the first semi-trailer chassis adjacent a first end of the base frame;

locking the first semi-trailer chassis to the base frame of the container by securing a lock at an end of the first semi-trailer chassis into the locking hole defined within the side beam of the base frame;

stacking a second semi-trailer chassis in a non-inverted manner on the first semi-trailer chassis and locating wheels of the second semi-trailer chassis adjacent a second end of the base frame of the container;

stacking a third semi-trailer chassis in an inverted manner on the second semi-trailer chassis and locating wheels of the third semi-trailer chassis adjacent the first end of the base frame of the container; and stacking a fourth semi-trailer chassis in a non-inverted manner on the third semi-trailer chassis and locating wheels of the fourth semi-trailer chassis adjacent the second end of the base frame of the container.

2. The method as recited in claim 1, wherein stacking a second semi-trailer chassis in a non-inverted manner on the first semi-trailer chassis includes placing a gooseneck beam of the second semi-trailer chassis in contact with the wheels of the first semi-trailer chassis and placing the wheels of the second semi-trailer chassis in contact with a gooseneck beam of the first semi-trailer chassis.

3. The method as recited in claim 1, wherein stacking a second semi-trailer chassis in a non-inverted manner on the first semi-trailer chassis includes placing an axle of a wheel suspension frame of the second semi-trailer chassis in contact with a reinforcing plate of a leg of the first semi-trailer chassis and placing a reinforcing plate of a leg of the second semi-trailer chassis in contact with an axle of a wheel suspension frame of the first semi-trailer chassis.

4. The method as recited in claim 3 further comprising stacking the four semi-trailer chassis in the container such that H is greater than the total of h, H1, H2, H3, and H4, wherein H is an external height of the container;

h is a height of the side beam of the base frame;

H1 is a vertical distance between a carrying face of the first semi-trailer chassis and a tangent point between the axle of the wheel suspension frame of the first semi-trailer chassis and the reinforcing plate of the leg of the second semi-trailer chassis;

H2 is a vertical distance between the tangent point between the axle of the wheel suspension frame of the first semi-trailer chassis and the reinforcing plate of the leg of the second semi-trailer chassis and a top point of an orthogonal projection of a gooseneck beam of the second semi-trailer chassis on a corner post;

H3 is a vertical distance between a carrying face of the third semi-trailer chassis and a tangent point between an axle of a wheel suspension frame of the third semi-trailer chassis and a reinforcing plate of a leg of the fourth semi-trailer chassis; and H4 is a vertical distance between the tangent point between the axle of the wheel suspension frame of the third semi-trailer chassis and the reinforcing plate of the leg of the fourth semi-trailer chassis and a top point of an orthogonal projection of a gooseneck beam of the fourth semi-trailer chassis on a corner post.

5. The method as recited in claim 1, wherein stacking a second semi-trailer chassis in a non-inverted manner on the first semi-trailer chassis includes placing the wheels and legs of the second semi-trailer chassis in contact with the base frame.

6. The method as recited in claim 1, further comprising the step of securing the four semi-trailer chassis to the container.

7. The method as recited in claim 1 further comprising stacking the four semi-trailer chassis such that the height of the stacked four semi-trailer chassis after placed in the container is less than the height of the container.

8. A method for loading chassis in a container comprising:

providing a container having a base frame and corner posts each extending between a lower end and an upper end, the base frame having corner parts at four corners of the container for interlocking containers and two side beams extending in a longitudinal direction between the corner parts, each side beam having an upper and a lower surface extending in the longitudinal direction from one corner part to another corner part and a locking hole defined between the upper and lower surfaces;

placing a chassis into the container;

inserting a locking device at an end of the chassis into the locking hole within the side beam of the base frame, and securing the chassis to the base frame.

9. The method as recited in claim 8, wherein placing the chassis into the container includes:

placing a first chassis in an inverted manner on the base frame of the container and locating wheels of the first chassis adjacent a first end of the base frame;

wherein the method further comprising stacking a second chassis in a non-inverted manner on the first chassis and locating wheels of the second chassis adjacent a second end of the base frame of the container.

10. The method as recited in claim 9 further comprising:

stacking a third chassis in an inverted manner on the second chassis and locating wheels of the third chassis adjacent the first end of the base frame of the container; and stacking a fourth chassis in a non-inverted manner on the third chassis and locating wheels of the fourth chassis adjacent the second end of the base frame of the container.

11. The method as recited in claim 10, wherein stacking the second chassis in a non-inverted manner on the first chassis includes placing a gooseneck beam of the second chassis in contact with the wheels of the first chassis and placing the wheels of the second chassis in contact with a gooseneck beam of the first chassis.

12. The method as recited in claim 10, wherein stacking the second chassis in a non-inverted manner on the first chassis includes placing an axle of a wheel suspension frame of the second chassis in contact with a reinforcing plate of a leg of the first chassis and placing a reinforcing plate of a leg of the second chassis in contact with an axle of a wheel suspension frame of the first chassis.

13. The method as recited in claim 12 further comprising stacking the four semi-trailer chassis such that H is greater than the total of h, H1, H2, H3, and H4, wherein H is an external height of the container;

h is a height of the side beam of the base frame;

H1 is a vertical distance between a carrying face of the first chassis and a tangent point between the axle of the wheel suspension frame of the first chassis and the reinforcing plate of the leg of the second chassis;

H2 is a vertical distance between the tangent point between the axle of the wheel suspension frame of the first chassis and the reinforcing plate of the leg of the second chassis and a top point of an orthogonal projection of a gooseneck beam of the second chassis on a corner post;

H3 is a vertical distance between a carrying face of the third chassis and a tangent point between an axle of a wheel suspension frame of the third chassis and a reinforcing plate of a leg of the fourth chassis; and H4 is a vertical distance between the tangent point between the axle of the wheel suspension frame of the third chassis and the reinforcing plate of the leg of the fourth chassis and a top point of an orthogonal projection of a gooseneck beam of the fourth chassis on a corner post.

14. The method as recited in claim 10 further comprising stacking the four semi-trailer chassis such that the height of the four stacked chassis after placed in the container is less than the height of the container.

* * * * *